US005607142A

United States Patent [19]

Nilsson

[11] Patent Number: 5,607,142

[45] Date of Patent: Mar. 4, 1997

[54] LIFTING APPARATUS

[76] Inventor: Per Nilsson, Östra Rönneholmsvägen 26, S-211 47 Malmö , Sweden

[21] Appl. No.: 341,551

[22] PCT Filed: Feb. 4, 1994

[86] PCT No.: PCT/SE94/00086

§ 371 Date: Nov. 21, 1994

§ 102(e) Date: Nov. 21, 1994

[87] PCT Pub. No.: WO94/22759

PCT Pub. Date: Oct. 13, 1994

[30] Foreign Application Priority Data

Mar. 26, 1993 [SE] Sweden ..... 9301016

[51] Int. Cl.[6] ..... B66D 1/60

[52] U.S. Cl. ..... 254/298; 254/316

[58] Field of Search ..... 254/289, 288, 254/298, 316

[56] References Cited

U.S. PATENT DOCUMENTS

| | | | |
|---|---|---|---|
| 353,564 | 11/1886 | Kamm et al. | 254/298 |
| 684,872 | 10/1901 | Sarazin | 254/298 |
| 1,259,445 | 3/1918 | Rees | 254/298 |
| 1,265,612 | 5/1918 | Cocke | 254/289 |
| 1,771,281 | 7/1930 | Wilsing | 254/316 |
| 2,221,359 | 11/1940 | Nesbitt | 254/289 |

*Primary Examiner*—Katherine Matecki
*Attorney, Agent, or Firm*—Ladas & Parry

[57] ABSTRACT

A lifting apparatus (1) comprises a frame (30) and a carrier device (12) for carrying a load (2). The lifting apparatus includes two separate suspension devices (11*a, b*) which, by respective lines (13*a, b*) are connected to respective rotary drums (14*a, b*) for winding or unwinding of the line. A switching device (15*a, b*) is provided for each respective drum and is disposed, in a first position, to interconnect the drum with a prime mover (16) for rotation of the drum (14*a, b*) in one direction of rotation in which the line (13*a, b*) is wound up onto or unwound from the drum. As a rule, the second drum is disengaged from the prime mover (16) when this drives that drum on which the line is wound up or from which the line is unwound.

12 Claims, 6 Drawing Sheets

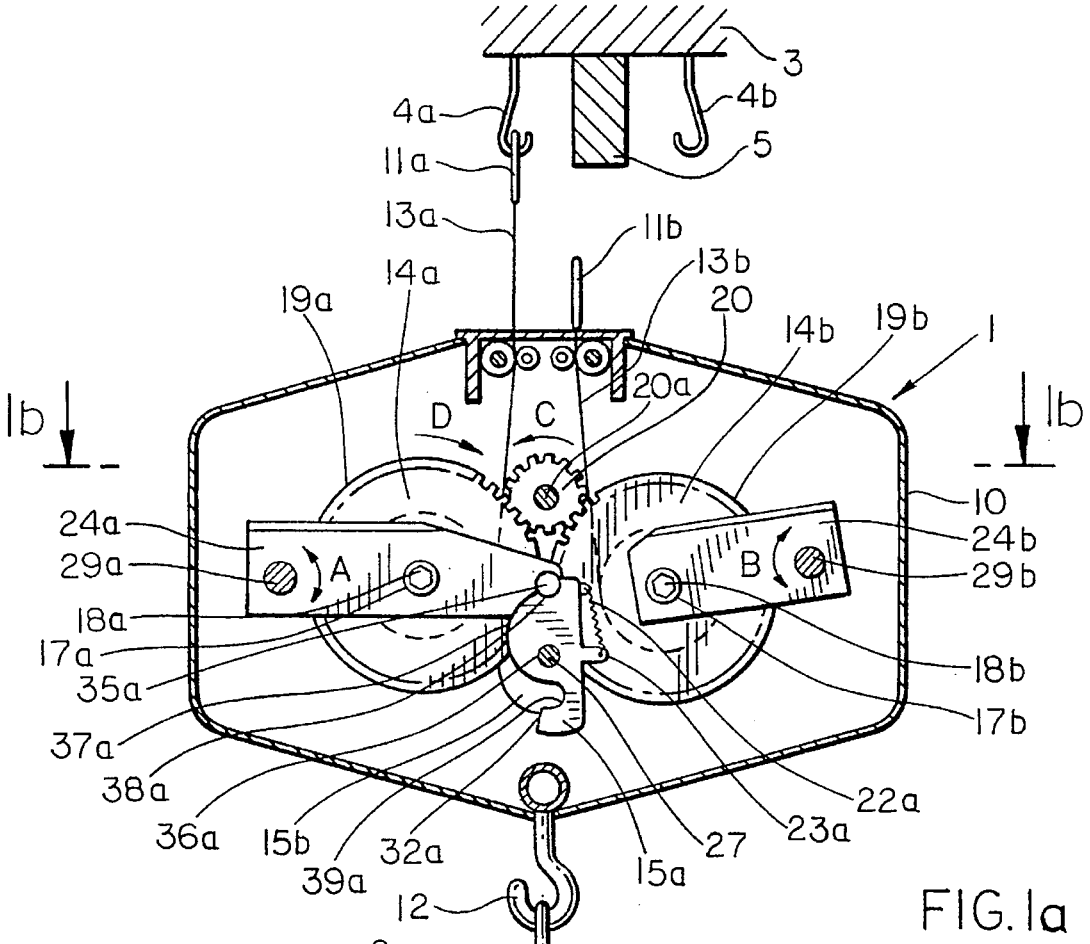
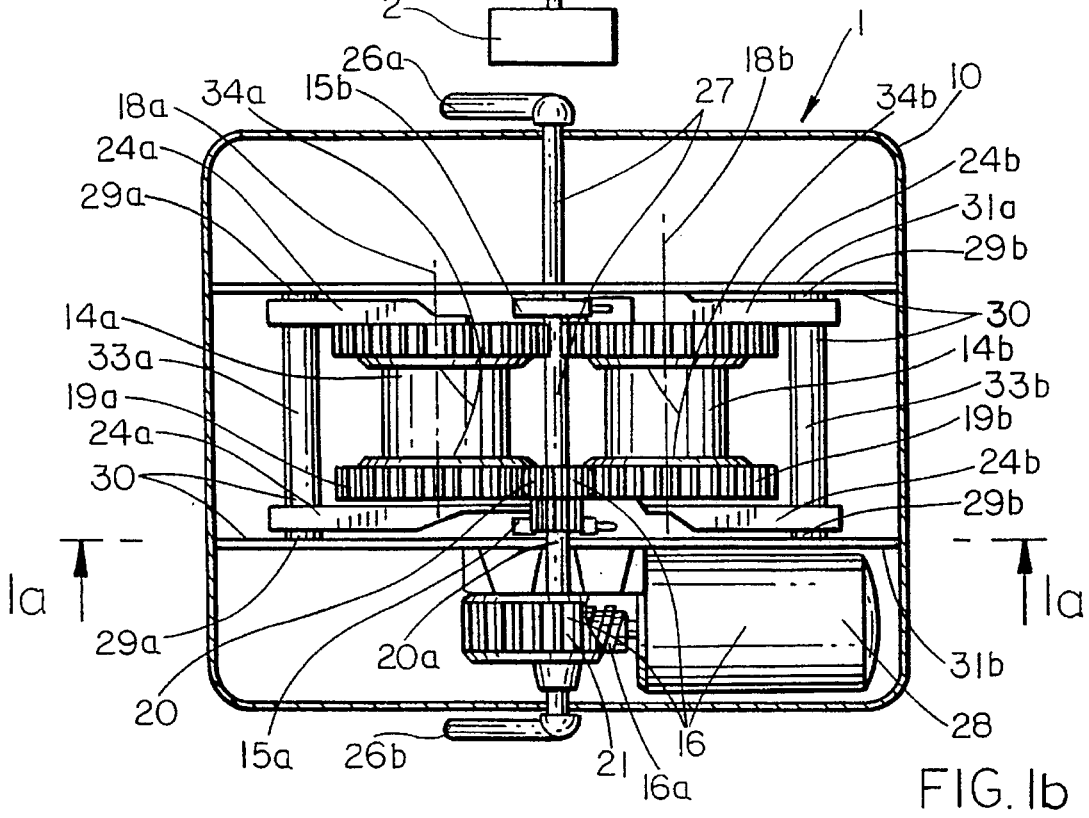
FIG. Ib

LIFTING APPARATUS

FIELD OF THE INVENTION

The present invention relates to a lifting apparatus capable of shifting a load from one support means to another.

BACKGROUND

There are needs in many contexts for a lifting apparatus which is arranged so that, while carrying a load, it may be moved from a first suspension device to a second suspension device. There are also often needs in this art to be able to move a load from one level to another.

Examples of practical applications where this need exists are where goods are to be moved through an intake or discharge opening in a wall, when the opening is located above ground level and the wall above the opening separates an outer suspension device from a suspension on device located inside the opening. It is obvious that a corresponding need exists when a load is to be moved from one loading apparatus to another, for example from a conveyor path suspended in a ceiling to a mobile hoist or crane, transfer of a patient sitting in a harness from one conveyor path to another conveyor path, to a bed, to a wheelchair, etc.

SUMMARY OF THE INVENTION

The present invention seeks to provide an apparatus which satisfies the above-disclosed needs. According to the invention, such apparatus comprises a frame supporting a carrier for a load, two rotary drums carried by the frame to which are secured respective flexible lines each having an end for suspension from an overhead support. The drums are each rotatable in opposite directions to wind up or pay out the respective line to raise or lower the load. A switching device is supported by the frame for each respective drum to switch the drum to a first position in which the drum is interconnected with a prime mover to rotate the drum in one direction or the other. When one drum is engaged with the prime mover the other drum can be disengaged to effect a switching operation and transfer of the frame from one overhead support to the other.

BRIEF DESCRIPTION OF THE DRAWINGS

The present invention will now be described in greater detail hereinbelow, with reference to the drawings, in which:

FIG. 1*a* is a vertical section taken along the line 1*a*–1*a* in FIG. 1*b* through one embodiment of an apparatus according to the present invention in a first working position;

FIG. 1*b* is a horizontal section taken along the line 1*b*–1*b* in FIG. 1*a* of the apparatus according to FIG. 1*a;*

DETAILED DESCRIPTION

Figure 2A:
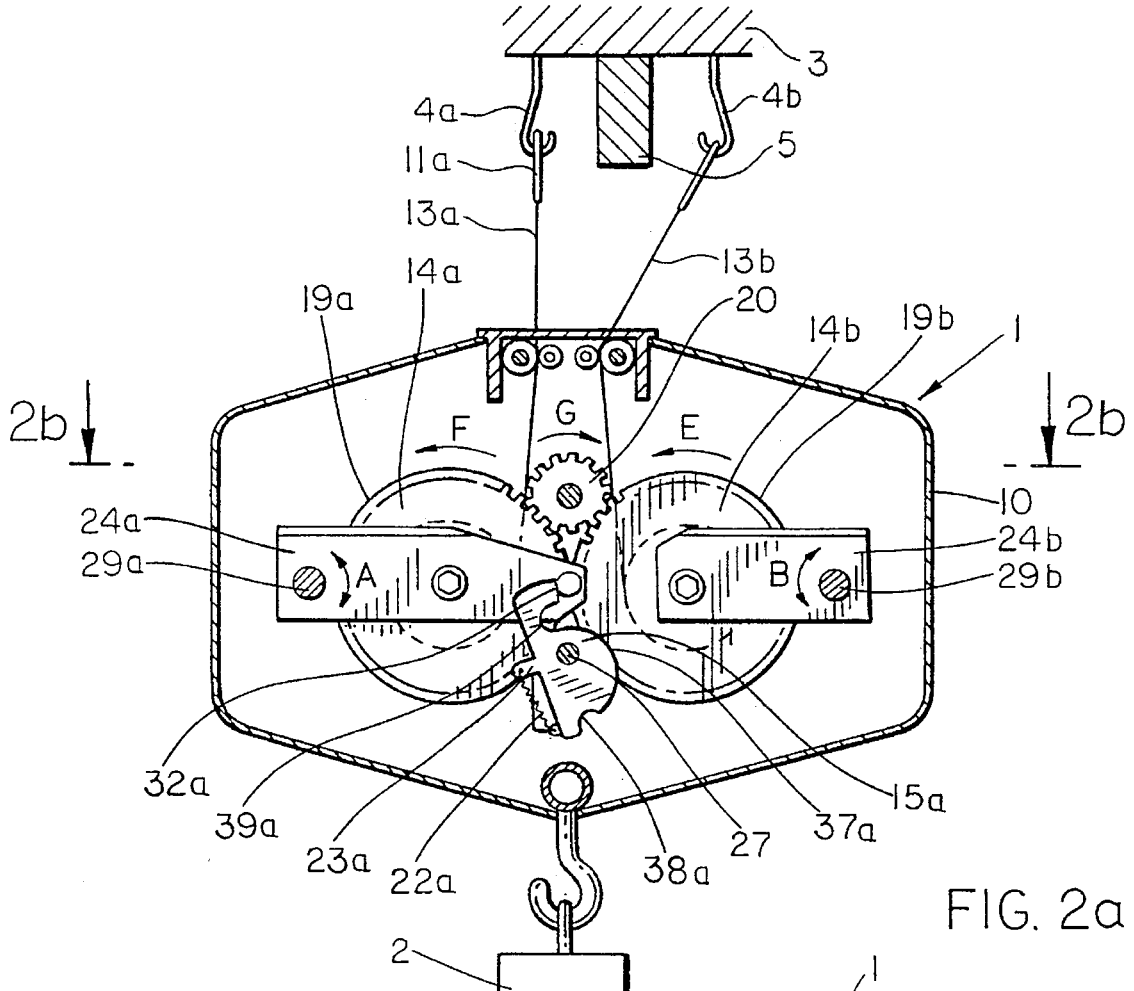
FIG. 2*a* is a vertical section taken along the line 2*a*–2*a* in FIG. 2*b* with the apparatus in a second working position.

The Figures of the drawings show a lifting apparatus 1 carrying a load 2 and arranged to be connected to coupling devices 4*a,b* which, in the Figures, are shown as secured to a ceiling 3 on either side of a wall 5 located beneath the ceiling. The space located beneath the walls example, correspond to a door opening.

The lifting apparatus 1 includes a frame 30, a carrier device 12 for carrying the load 2 and two separate suspension devices 11*a*,11*b*. The suspension devices are arranged so as to be able to be interconnected with the coupling devices 4*a,b*. In the Figures, the coupling devices 4*a,b* are shown as hooks, and the suspension devices 11*a,b* are shown as lugs.

In the illustrated embodiment, the frame 30 is composed of two opposing end plates 31*a*,31*b* which are connected by cross-stays 33*a*,33*b*. A housing 10 surrounds the frame, together with substantially all of those devices which are included in the apparatus.

A first drum 14*a* and a second drum 14*b* are each suspended by means of journals 17*a*,17*b* in bracket devices (holders) 24*a*,24*b*, hereinafter also referred to as first bracket 24*a* and second bracket 24*b*. The drums are rotatable in the journals 17*a,b* and have mutually parallel axes of rotation or shafts 18*a*,18*b*. In their turn, the brackets 24*a,b* are rotatably journalled via journals 29*a*,29*b* in the frame 30 (cf. the arrows A and B) for displacement of each respective drum 14*a,b* between a first (upper) position and a second (lower) position. In the Figures, the journals 29*a,b* of the brackets are disposed on the cross-stays 33*a,b*, but it will be obvious to the skilled artisan that the journals, in other embodiments, can be arranged on special devices which are connected to the frame.

Each drum 14*a,b* is defined in the axial direction at each end by a guide flange 34*a,b* which guides the winding onto the drum of an elongate and flexible device 13*a*,13*b*, for example a strap or a line. The peripheral edge of one guide flange is, in the illustrated embodiment, provided at each drum with teeth whereby the guide flange forms a circumferential gear rim 19*a*,19*b*. In the illustrated embodiment, the teeth are disposed on that flange which, in both drums, is turned to face in the same direction, in addition to which the teeth are generally axially oriented. In certain embodiments, obliquely cut teeth are also employed.

A prime mover or drive means 16 is connected to the frame and, in the embodiment shown in the drawings, comprises an electric motor 28, a gear 21 and a gear wheel 20. The gear wheel 20 is placed and disposed such that its teeth are parallel with the teeth 19*a,b* of the drums 14*a,b* and disposed adjacent thereto. Thus, the gear wheel 20 has a fixed position in relation to the frame but is rotatable about its center axis. The motor 28 drives the gear wheel 20 via the gear 21 which is connected to gear wheel 20 by shaft 20*a*. The motor 28 drives the gear 21 in a conventional manner such as, by a worm gear 16*a* on the output shaft of the motor 28.

Switching devices 15*a* and 15*b*, respectively, are provided for each respective drum 14*a,b*. The switching devices 15*a,b* are interconnected with one another by means of a mechanical element 27. Each switching device 15*a,b* is rotatably journalled in a journal 36*a* and 36*b*, respectively, of the mechanical element 27. In the Figures, the mechanical element is shown in one embodiment in which it is designed as a shaft 27 which, in turn, is rotatably journalled in the frame 30. Each respective switching device is provided with a guide surface 37*a*,37*b* which, in a first end region, is provided with a first retainer member 38*a*,38*b* and, in its other end region, with a second retainer member 39*a*,39*b*. In the Figures, the retainer members are shown as recesses or depressions in the guide surface of a configuration adapted to the shape of a guide member 35*a*,35*b* shown in the Figures as a pin disposed on each of the bracket devices 24*a,b*. The pin is disposed on the same side of the journals 29*a,b* of the brackets 24*a,b* as the journals 17*a,b* of the drum and, as a rule, further away from the journal of the bracket device than the center shafts 18*a,b* of the drums. Each retainer member 38*a,b* and 39*a,b* of guide surface 37*a,b* is of concave configuration and the distance to the journal 36*a,b* of the switching device 15*a,b* is greater at the first retainer member 38*a,b* than at the second retainer member 39*a,b*. Outside the second retainer member, the switching devices merge into respective abutment surfaces 32*a,b*. The abutment of the switching devices 15*a,b* are, thus, disposed a greater distance from the journals 17*a,b* of the drums than the second retainer members 39*a,b*.

The mechanical element (the shaft) 27 is rotatable about its center axis between two rotary end positions which are offset 180° in relation to one another. In the Figures, one embodiment is shown of manual operating devices 26*a*,26*b* each at an end of the shaft 27 for switching the shaft between its two end positions. The switching devices 15*a,b* have substantially identical configuration of their guide surfaces 37*a,b* and the devices are mounted in mirror-reversed relationship on the shaft 27 and angularly offset by 180° in relation to one another. The switching devices 15*a,b* are mounted on the shaft 27 such that, when the first retainer member 38*a* of one switching device 15*a* is located adjacent to the guide member 35*a* (the guide pin) of the first bracket 24*a*, the first retainer member 38*b* of the second switching device 15*b* is located furthest away from the guide member 35*b* (the guide pin) of the second bracket 24*b*. Each respective switching device 15*a,b* is returnably rotatable on the shaft 27 from one end position constituting substantially the position of rotation in relation to the shaft 27 in which the switching device 15*a*,15*b*, respectively, is located when the second retainer member 39*a,b*of the guide surface 37*a,b* of the switching device 15*a,b* is located most proximal the guide pin 35*a,b*. A spring 22*a,b* is secured in a pretensioned manner to a radially directed arm 23*a,b* fixedly connected with the shaft 27 and to each respective switching device 15*a,b* so as to apply a torque on the switching device for returning the switching device to the end position.

Figure 4A:
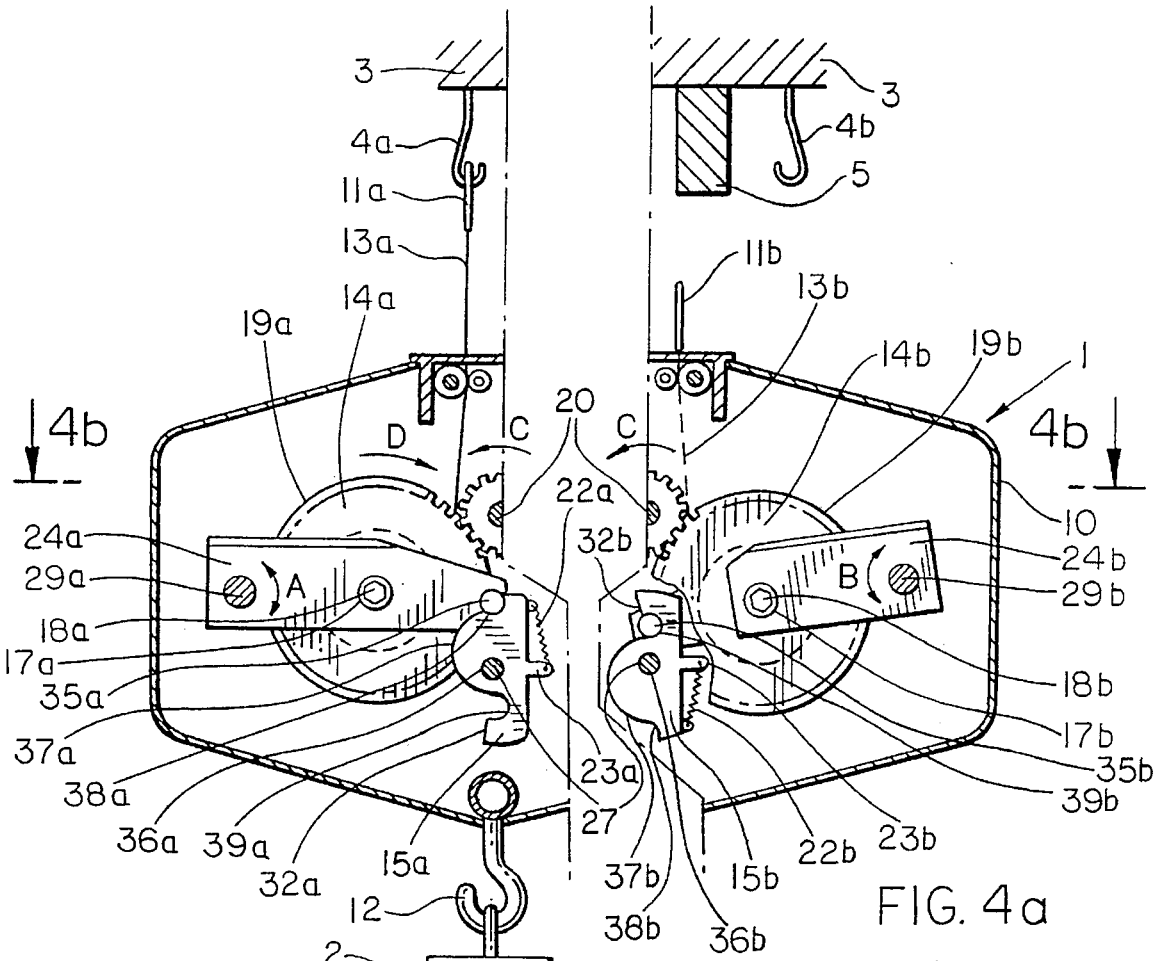
FIGS. 4*a* and 4*b* are vertical sections and horizontal sections, respectively, of the apparatus corresponding to those shown in FIGS. 1*a–b*, but with the left- and right-hand sections of the Figures separated and with the right-hand section of Figures partly cut away.
Figure 4B:
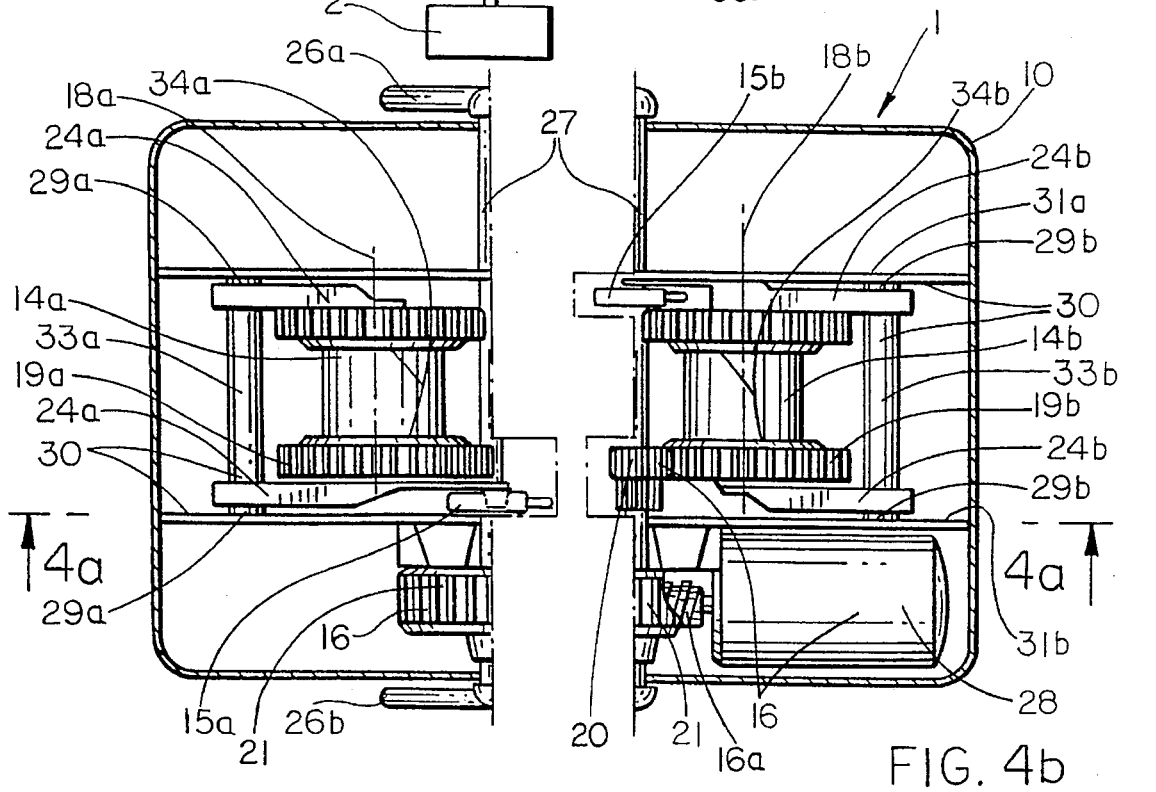
Figure 5A:
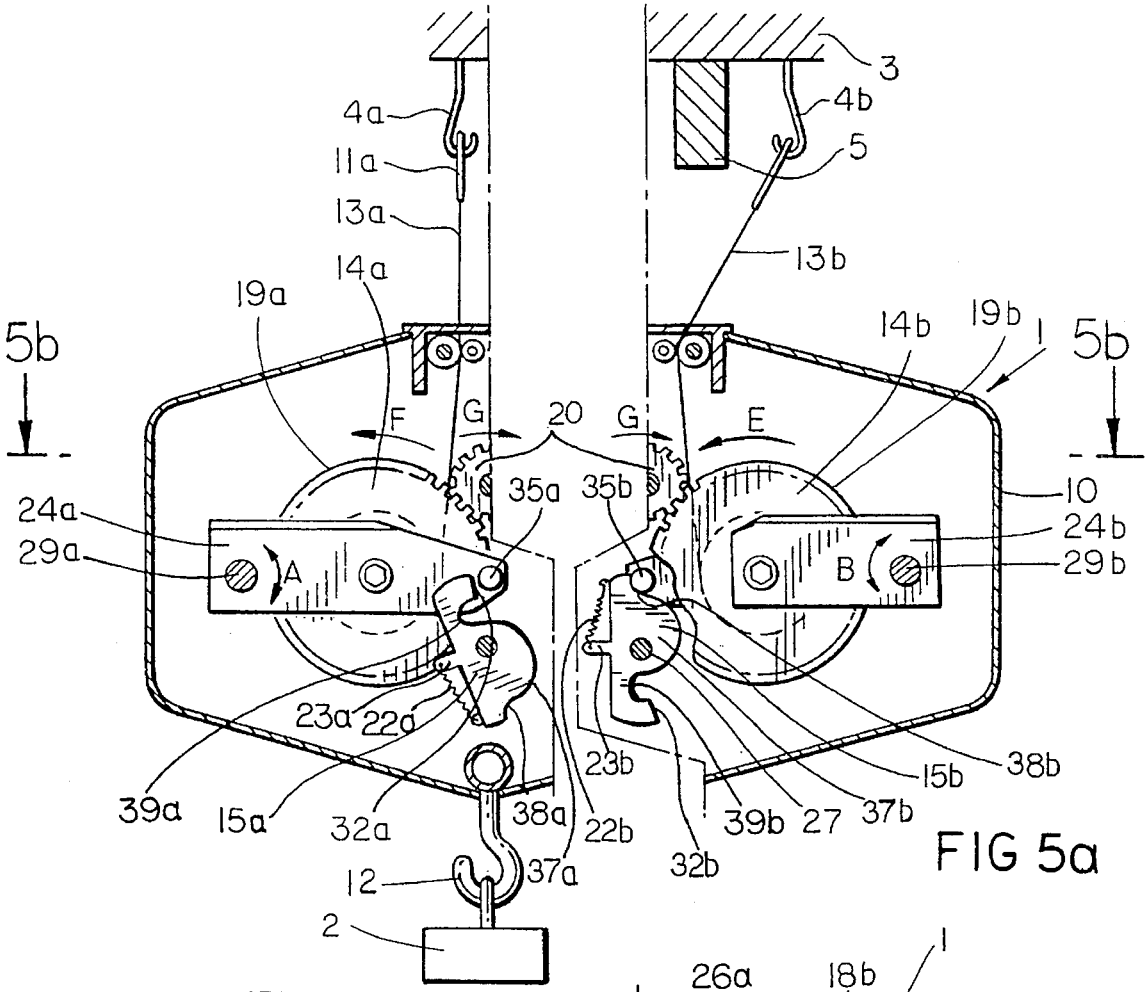
FIGS. 5*a* and *b* are vertical sections and horizontal sections, respectively, corresponding to that shown in FIGS. 4*a–b* but with the apparatus in the second working position.
Figure 5B:
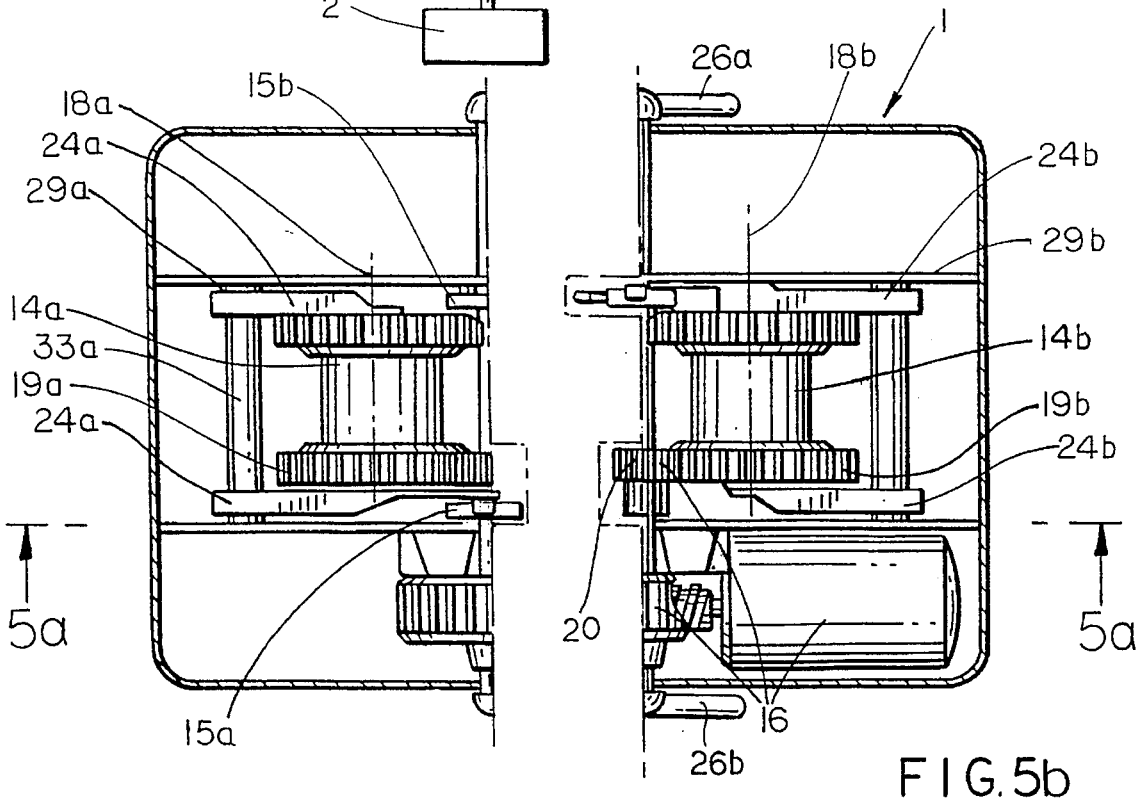
Figure 6A:
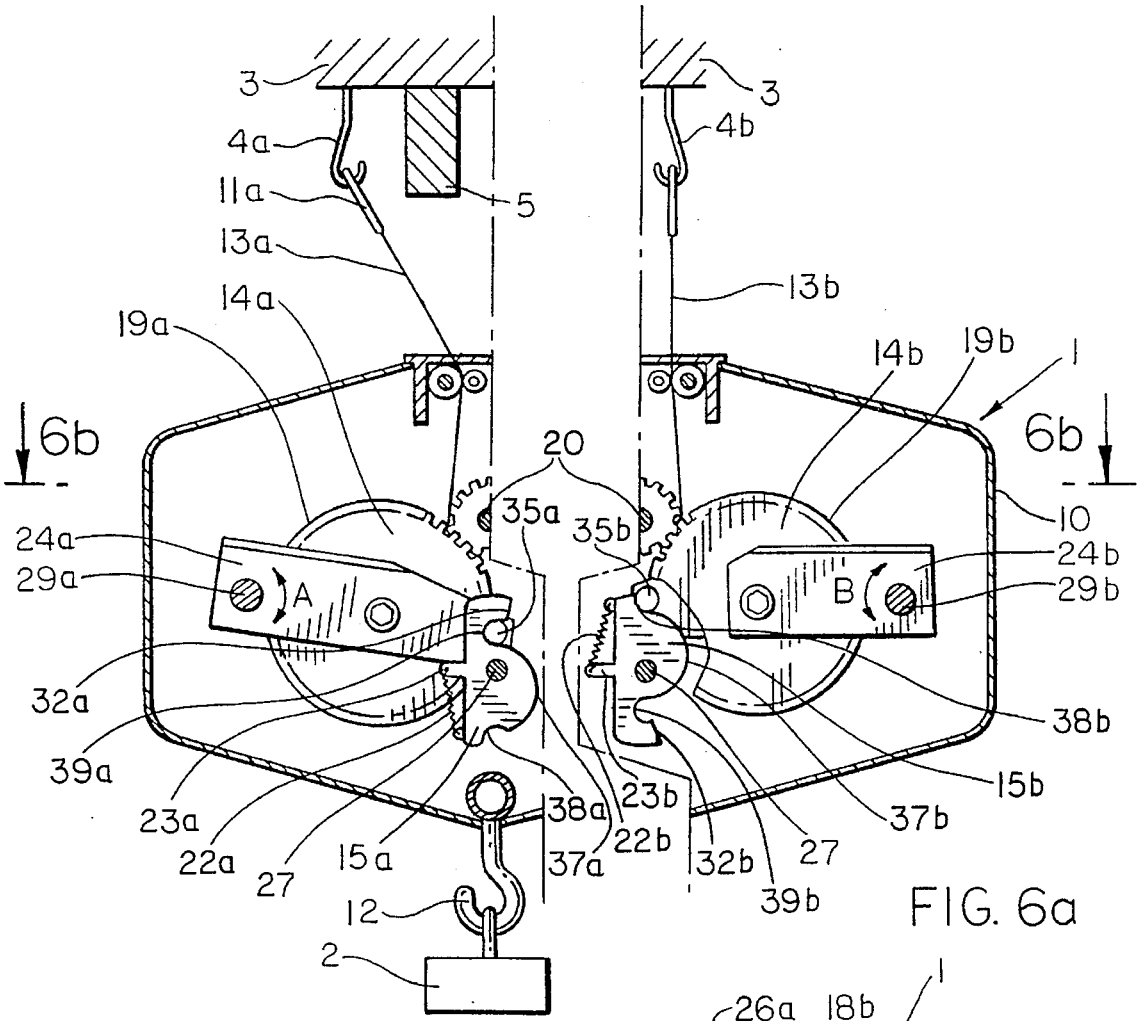
FIGS. 6*a* and *b* are vertical sections and horizontal sections, respectively, corresponding to those shown in FIGS. 4*a–b*, but with the apparatus in the third working position.
Figure 6B:
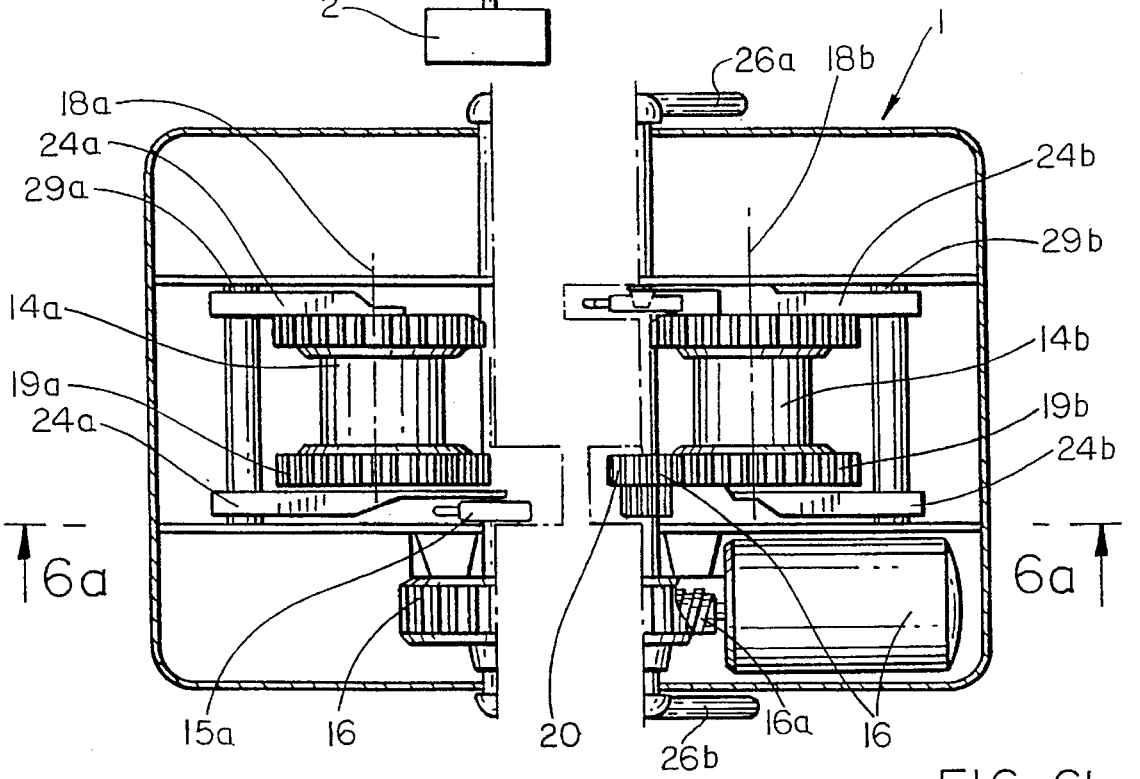

In the separated sections shown in FIGS. 4–6, the sections are partly cut away in FIGS. 4*a*,5*a* and 6*a* so as to show the positions of the switching device 15*b* on switching of the second (right-hand) drum 14*b* between its first and second (upper and lower, respectively) positions.

In FIGS. 1*a* and 1*b* and 4*a* and 4*b*, the first switching device 15*a* is shown oriented with its first retainer member 38*a* cooperating with the guide pin 35*a* of the first bracket 24*a*. Since the first retainer member 38*a* is located furthest away from the journal 36*a* of the switching device, the bracket 24*a* is displaced to and retained by the switching device 15*a* in its upper position. This means that the gear rim 19*a* of the first drum 14*a* is in mesh with the gear wheel 20 of the prime mover 16. When the prime mover rotates the gear wheel 20 in the direction of the arrow C, the first drum 14*a* rotates in the direction of the arrow D and the strap 13*a* is wound on the first drum 14*a*. Hereby, the lifting apparatus i and therewith its load 2 is lifted upwardly. When the motor is stopped, the lifting apparatus is retained at an unchanged level by a brake integrated into the prime mover, for example an electric or mechanical brake. When the motor drives the gear wheel 20 in the opposite direction, the strap is unwound from the drum 14*a*.

As is particularly apparent from FIG. 4*a*, the second switching device 15*b* is located in a position in which its second retainer member 39*b* cooperates with the guide pin 35*b* of the second bracket device 24*b*. Since the distance between the guide surface 37*b* and the journal 36*b* of the second switching device 15*b* is at its smallest here, the bracket 24*b* is located in its lowest position, and the gear rim 19*b* of the drum is disengaged from the gear wheel 20. It is thereby possible, for example manually to draw out the strap 13*b* from the second drum 14*b*.

Figure 2B:
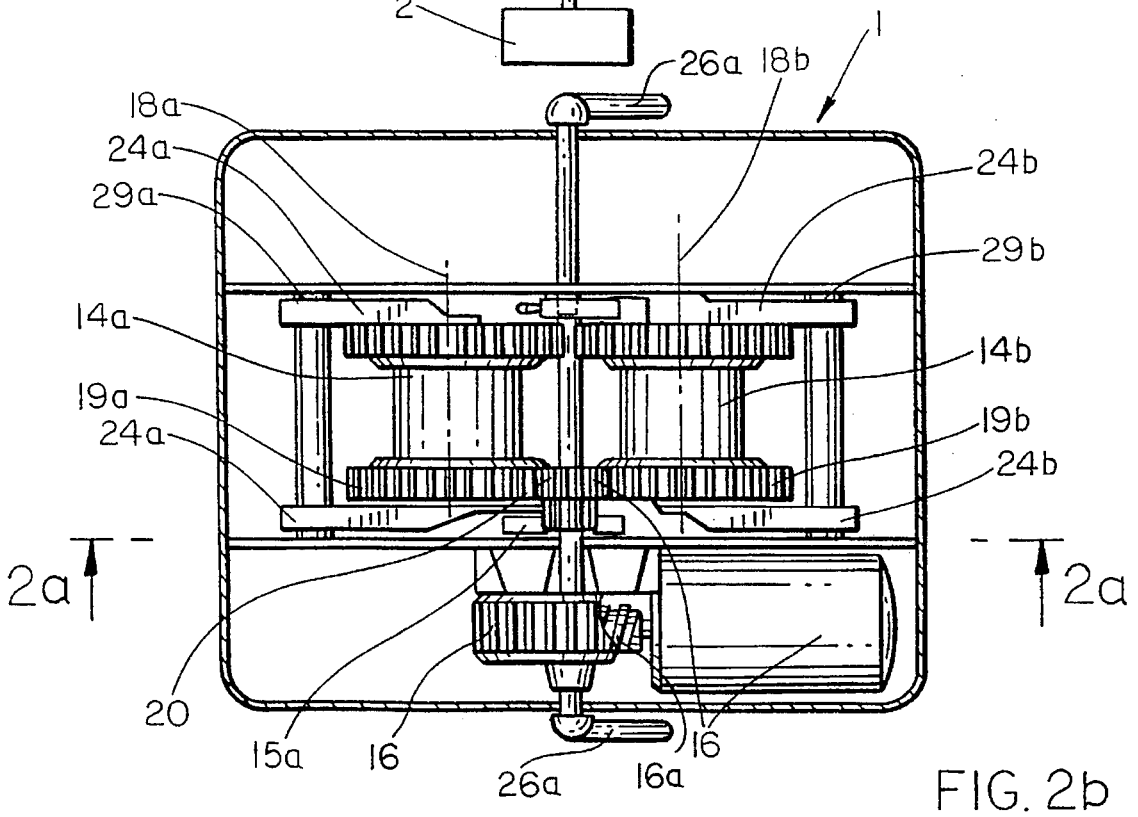
FIG. 2*b* is a horizontal section of the apparatus taken along the line 2*b*–2*b* in FIG. 2*a;*
Figure 3A:
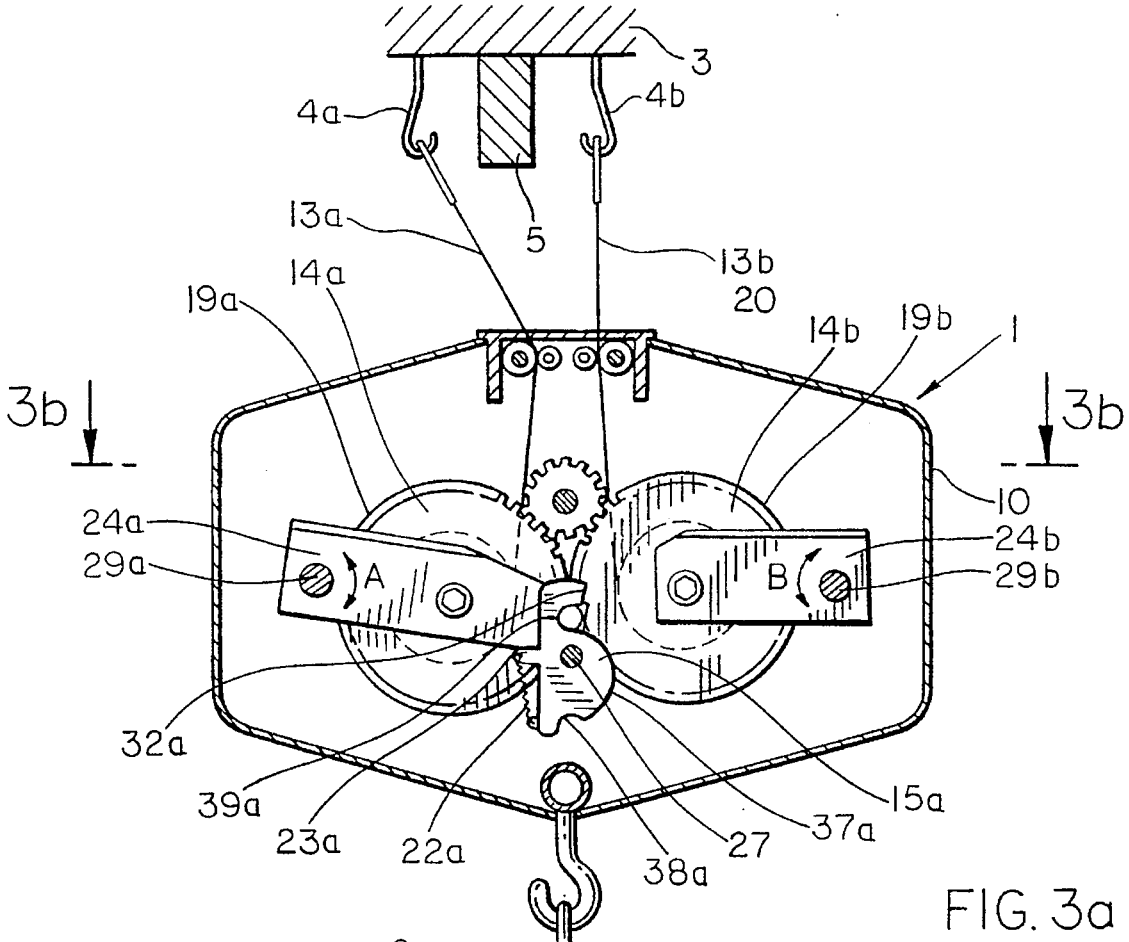
FIG. 3*a* is a vertical section taken along the line 3*a*–3*a* in FIG. 3*b*, but with the apparatus in a third working position.
Figure 3B:
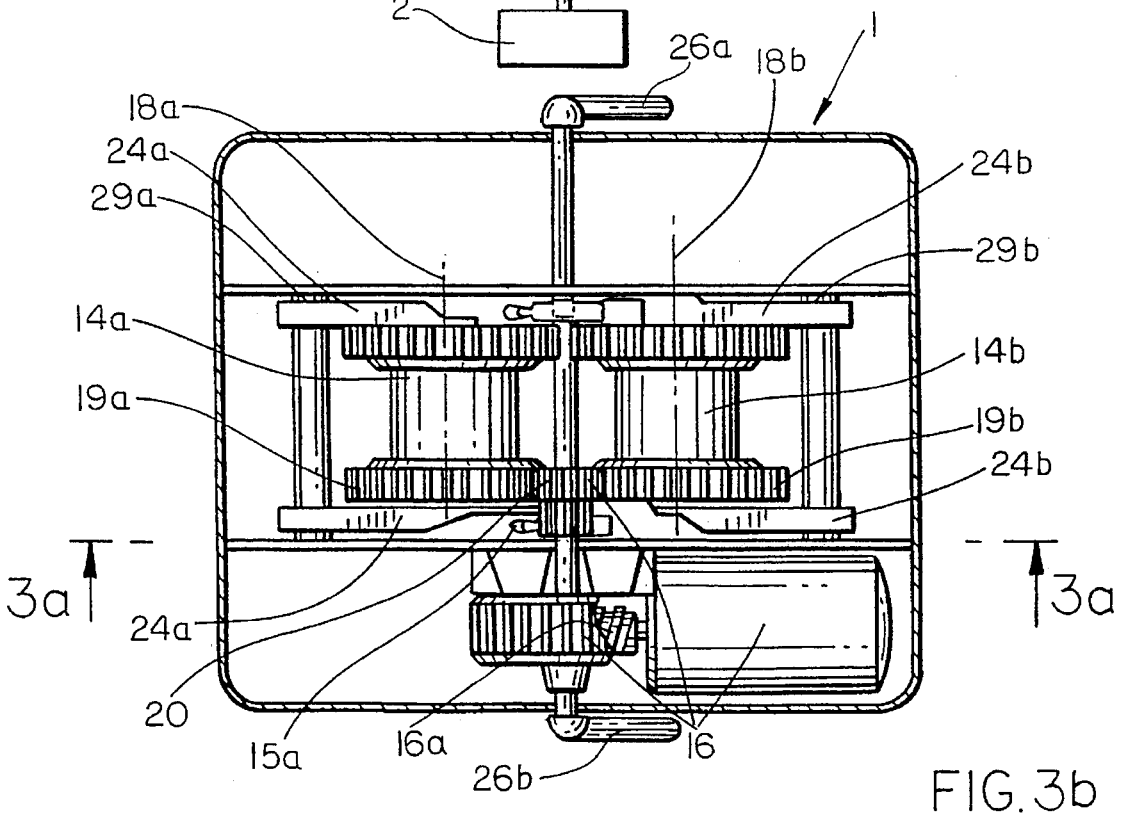
FIG. 3*b* is a horizontal section of the apparatus taken along the line 3*b*–3*b* in FIG. 3*a;*

In FIGS. 2*a* and 2*b*, as well as in 5*a* and 5*b*, it is shown how the second strap 13*b* is connected to the second coupling device 4*b*. The operating device 26*a,b* has been switched from the position illustrated in FIGS. 1*a,b* and 4*a,b* to its opposite position and the second switching device 15*b* has thereby been switched so that its second retainer member 38*b* cooperates with the guide pin 35*b* of the second bracket 24*b*. The second bracket 24*b* has thereby, on the rotation of the switching device 15*b*, been displaced by the guide surface 37*b* of the device 15*b* to its highest position and, thereby, the drum 14*b* has been moved to a position in which its gear rim 19*b* is in engagement with the gear wheel 20.

The first switching device 15*a* has also accompanied the operating shaft 27 in its rotation, as a result of which it has been moved from the position illustrated in FIG. 1*a* to the position illustrated in FIGS. 2*a* and 5*a*. The gear rim 19*a* of the first drum 14*a* is, however, still located in mesh with the gear wheel 20. The reason for this is that the first strap 11*a* still takes up the entire load and, thereby, retains the first drum 14*a* in its uppermost position. The second retainer member 39*a* of the guide surface 37*a* will not, therefore, reach the guide pin 35*a*. The abutment surface 32*a* of the switching device 15*a* located outside the second retainer member 39*a* abuts, under spring action against the guide pin 35*a* of the first bracket 24*a*. The switching device 15*a* is, thereby, rotated out of its end rotary position and the spring 22*a* has been further extended. When the gear wheel 20 is rotated by the prime mover 16 in the direction of the arrow G, the second strap 13*b* is tensioned due to rotation of the second drum 14*b* in the direction of the arrow E. At the same time, the gear wheel 20 rotates the first drum 14*a* in the direction of the arrow F. On rotation of the drums 14*a,b*, the strap 13*a* is paid out from the first drum 14*a*, at the same time as the strap 13*b* is drawn in on the second drum 14*b*. The load will thereby be progressively transferred to the second strap 13*b*. Since approximately the same amount of strap is paid out from the first drum as the second drum draws in, the lifting apparatus will, when the load has been wholly transferred to the second strap 13*b*, be located on approximately the same level as when the first strap 13*a* carried the entire load.

When the first strap 13*a* no longer carries any load, the force of gravity displaces the first bracket 24*a* downwardly in Figure 1*a*. Since the abutment surface 32*a* of the first switching device 15*a* no longer abuts against the guide pin 35*a*, the spring 22*a* draws the switching device to the position illustrated in FIG. 6*a*, i.e. to that position in which the second retainer member 39*a* of the first switching device 15*a* is in engagement with the guide pin 35*a*. The first drum 14*a* is thereby locked in its lower position (cf. FIG. 6*a*). The entire load has now been transferred to the second band or strap 13*b*. The first drum 14*a* is now wholly disengaged. The desired length of the first band 13*a* can now be drawn out from the first drum and the desired position of the load be obtained by allowing the prime mover 16 to rotate the second drum 14*b* in a direction which either draws in the band or line 13*b* or pays out the line in order to raise or lower the load.

In one preferred embodiment, the drums 14*a,b* are provided with torsion springs which reverse each respective drum for drawing in the strap 13*a,b* when the drum is no longer in engagement with the gear wheel 20 and the strap has been disengaged from the relevant coupling device 4*a,b*.

The above detailed description has referred to but a limited number of embodiments of the present invention, but it will be readily perceived by a person skilled in the art that the present invention encompasses a large number of embodiments without departing from the spirit and scope of the appended claims.

I claim:

1. A lifting apparatus comprising a frame, a carrier supported by said frame for carrying a load, first and second separate suspension devices each including a respective flexible line and first and second drums rotatably supported by said frame, said first and second lines being respectively connected to said first and second drums for being respectively wound thereon or paid out therefrom depending on the direction of rotation of the respective drums, a drive means, and first and second switching means respectively for said drums and each disposed, in a first position, to interconnect the respective drum with said drive means for rotation of said respective drum in one direction of rotation in which the flexible line is wound onto or unwound from the drum.

2. The lifting apparatus as claimed in claim 1, comprising an operating device connected to said first and second switching means for displacing only one of said switching means at one time to said first position thereof.

3. The lifting apparatus as claimed in claim 2, wherein said drums have mutually parallel axes of rotation, said drums respectively including circumferential gear rims, said drive means including a gear wheel which is in mesh with the respective gear rim of each drum when said drum is in said first position.

4. The lifting apparatus as claimed in claim 3, wherein said first and second switching means comprises respective brackets in which said drums are rotatably supported, said brackets being rotatably journalled by said frame for displacement of each respective drum between said first position and a second position in which the drum is disengaged from the drive means.

5. The lifting apparatus as claimed in claim 4, wherein said second position the gear rim of the drum is disengaged from said gear wheel.

6. The lifting apparatus as claimed in claim 5, wherein said first and second switching means are rotatably journalled in a journal which is fixed to said frame.

7. The lifting apparatus as claimed in claim 6, wherein said first and second switching means are rotatable respectively on said journal between a first position in which the respective switching means retains its respective drum in said first position thereof, and a second position in which the respective switching means retains its respective drum in said second position thereof.

8. The lifting apparatus as claimed in claim 7, wherein said brackets include respective guide pins, said switching means each having a respective guide surface which, during displacement of the switching means to said first position, abuts against the respective guide pin for displacement of the respective bracket and thereby the respective drum to said first position.

9. The lifting apparatus as claimed in claim 8, wherein said switching means each has one end region of the guide surface provided with a recessed portion constituting a retainer member of the guide surface for fixedly retaining the respective bracket and thereby the respective drum in said second position.

10. The lifting apparatus as claimed in claim 9, wherein said switching means each has another end region of the guide surface provided with a second recessed portion constituting a second retainer member of the guide surface for fixedly retaining the respective bracket and thereby the respective drum in said first position.

11. The lifting apparatus as claimed in claim 1, comprising a mechanical element interconnecting said first and second switching means, said first and second switching means being mirror-reversed and angularly rotatable by said mechanical element through 180° in relation to one another in end positions thereof.

12. The lifting apparatus as claimed in claim 11, wherein each of said first and second switching means comprises a respective switching member having first and second retainer portions which are moved by said mechanical element such that in one end position of the switching means one of the retainer portions maintains the respective drum in said first position whereas in the other end position of the switching means the other of the retainer portions maintains the drum in a second position in which the drum is disengaged from the prime mover.

* * * * *